US006550084B2

(12) United States Patent
Siepmann et al.

(10) Patent No.: US 6,550,084 B2
(45) Date of Patent: Apr. 22, 2003

(54) MEDICAL EXAMINATION TABLE STEP

(75) Inventors: Paul J. Siepmann, Hartland, WI (US); Michael J. Marchant, Franklin, WI (US); Edward A. Raleigh, Waunakee, WI (US)

(73) Assignee: The Brewer Company, LLC, Manomonee Falls, WI (US)

( * ) Notice: Subject to any disclaimer, the term of this patent is extended or adjusted under 35 U.S.C. 154(b) by 0 days.

(21) Appl. No.: 09/884,433

(22) Filed: Jun. 19, 2001

(65) Prior Publication Data

US 2002/0189017 A1 Dec. 19, 2002

(51) Int. Cl.[7] ..... A47B 23/02
(52) U.S. Cl. ..... 5/507.1; 5/624
(58) Field of Search ..... 5/600, 621, 624, 5/507.1; 182/35, 88; 312/204, 235.3, 249.8, 330.1

(56) References Cited

U.S. PATENT DOCUMENTS

| | | | | | |
|---|---|---|---|---|---|
| 217,646 | A | | 7/1879 | Sherer | |
| 487,625 | A | | 12/1892 | Kales | |
| 488,649 | A | | 12/1892 | Daggett | |
| 542,060 | A | | 7/1895 | Lentz | |
| 1,039,708 | A | | 10/1912 | Denquer | |
| 1,684,889 | A | | 9/1928 | Russ | |
| 1,891,629 | A | | 12/1932 | Van Wagner | |
| 1,967,422 | A | | 7/1934 | Nadelson | |
| 2,267,973 | A | | 12/1941 | Demcak | |
| 2,272,819 | A | | 2/1942 | Poetsch et al. | |
| 2,565,784 | A | | 8/1951 | Sheean | |
| 2,606,801 | A | * | 8/1952 | Shampaine | 5/600 |
| D170,305 | S | | 9/1953 | Claus | |
| 2,652,887 | A | | 9/1953 | Fitzgerald | |
| 2,659,902 | A | * | 11/1953 | Fitzgerald et al. | 5/507.1 |
| 2,679,445 | A | | 5/1954 | Roehm | |
| 2,682,671 | A | * | 7/1954 | Faure | 5/507.1 |
| 2,788,529 | A | | 4/1957 | Moritzacky et al. | |
| 2,941,215 | A | * | 6/1960 | Johnson | 5/507.1 |
| 3,016,275 | A | | 1/1962 | Grant | |
| D204,222 | S | | 3/1966 | Dailey | |
| 3,281,141 | A | | 10/1966 | Smiley et al. | |
| D207,081 | S | | 2/1967 | Katzfrey et al. | |
| D207,483 | S | | 4/1967 | Dottinger | |
| 3,334,951 | A | | 8/1967 | Douglass, Jr. et al. | |
| 3,348,893 | A | | 10/1967 | Katzfey et al. | |
| 3,409,287 | A | | 11/1968 | Chervenka | |
| 3,413,663 | A | | 12/1968 | Swann | |
| 3,499,529 | A | | 3/1970 | Katzfey et al. | |
| 3,638,935 | A | | 2/1972 | Lelugas et al. | |
| 3,658,317 | A | | 4/1972 | Bartlett et al. | |
| 3,814,414 | A | | 6/1974 | Chapa | |
| 3,944,205 | A | | 3/1976 | Mueller | |
| 4,003,704 | A | | 1/1977 | Zurolo et al. | |
| 4,034,972 | A | | 7/1977 | Peterson | |
| D245,287 | S | | 8/1977 | Damico et al. | |
| 4,045,078 | A | | 8/1977 | Shine | |
| 4,057,240 | A | | 11/1977 | Damico et al. | |
| 4,076,230 | A | | 2/1978 | Pike | |
| D250,043 | S | | 10/1978 | Shine | |
| 4,168,099 | A | | 9/1979 | Jacobs et al. | |
| 4,180,002 | A | | 12/1979 | Huempfner | |

(List continued on next page.)

OTHER PUBLICATIONS

US 2001/000363 A1, Apr. 26, 2001.
US 2002/000008 A1, Jan. 3, 2002.

*Primary Examiner*—Frederick L. Lagman
(74) *Attorney, Agent, or Firm*—Ryan Kromholz & Manion, S.C.

(57) ABSTRACT

A retractable and self-supporting step for a medical examination table and a method for use. The step having a large top with a safety mat for ease of use and patient maneuverability can be selectively extended from a cavity located on a medical examination and returned when not in use. The step is self-supporting, thus providing enhanced stability and safety during use.

18 Claims, 4 Drawing Sheets

U.S. PATENT DOCUMENTS 4,183,596 A 1/1980 Greene et al.
4,221,371 A 9/1980 Kuphal
4,284,268 A 8/1981 Gauthier
4,287,422 A 9/1981 Kuphal et al.
D263,777 S 4/1982 Thompson
4,322,899 A 4/1982 Clune
D265,241 S 6/1982 Patterson
D265,242 S 6/1982 Patterson
D266,023 S 8/1982 McLachlan
D266,765 S 11/1982 Clune
4,383,351 A 5/1983 Fenwick
4,407,687 A 10/1983 Mitchell
4,501,414 A 2/1985 Mason et al.
4,506,872 A 3/1985 Westerberg et al.
4,508,387 A 4/1985 Gilbert et al.
D278,668 S 5/1985 Simpkins
4,516,805 A 5/1985 Leeper et al.
4,529,185 A 7/1985 Gutierres
4,540,165 A 9/1985 Green et al.
4,545,628 A * 10/1985 Richey ..... 182/88
4,547,092 A 10/1985 Vetter et al.
4,552,403 A 11/1985 Yindra
4,557,471 A 12/1985 Pazzini
4,558,857 A 12/1985 Heller
D282,398 S 1/1986 Yindra
4,586,398 A 5/1986 Yindra
4,586,762 A 5/1986 Kennedy et al.
4,589,642 A 5/1986 Schnelle et al.
4,600,248 A 7/1986 Pflieger
4,602,756 A 7/1986 Chatfield
4,606,575 A 8/1986 Kodet
D286,481 S 11/1986 Case et al.
4,653,129 A 3/1987 Kuck et al.
4,667,354 A 5/1987 Carey, Jr. et al.
4,667,605 A 5/1987 Bastian
4,691,393 A 9/1987 Kuck
4,700,916 A 10/1987 Bastian et al.
4,716,840 A 1/1988 Tringali et al.
4,717,102 A 1/1988 Pflieger
4,732,089 A 3/1988 Mueller
4,732,430 A 3/1988 Byrns
4,750,305 A 6/1988 Bastian
4,752,977 A 6/1988 Smith et al.
D297,597 S 9/1988 Simpkins et al.
4,796,846 A 1/1989 Meier et al.
4,805,365 A 2/1989 Bastian
D300,657 S 4/1989 Simpkins et al.
4,819,569 A 4/1989 Bastian et al.
4,821,350 A 4/1989 Feldt
D300,997 S 5/1989 Simpkins et al.
4,826,117 A 5/1989 Bastian et al.
D301,925 S 6/1989 Simpkins et al.
4,846,431 A 7/1989 Pflieger
4,852,941 A 8/1989 Jones
4,858,260 A 8/1989 Failor et al.
4,865,303 A 9/1989 Hall
4,872,657 A 10/1989 Lussi
4,905,266 A 2/1990 Kuck et al.
4,916,725 A 4/1990 Quinter et al.
4,937,902 A * 7/1990 Ceike Shapiro ..... 182/88
4,956,592 A 9/1990 Schulte et al.
4,958,816 A 9/1990 Chaney et al.
4,961,610 A 10/1990 Reeder et al.
4,966,351 A 10/1990 Klepacki
4,968,013 A 11/1990 Kuck
4,973,034 A 11/1990 Michele
4,996,731 A 3/1991 Kruyt
5,005,667 A * 4/1991 Anderson ..... 182/35
D319,158 S 8/1991 Jones et al.
5,037,053 A 8/1991 Fox et al.
D321,097 S 10/1991 Jones et al.
5,078,349 A 1/1992 Smith
5,081,808 A 1/1992 Bastian et al.
5,084,927 A 2/1992 Parkevich
D326,381 S 5/1992 Heiligenthal et al.
D330,771 S 11/1992 Chaney et al.
D330,813 S 11/1992 Spitzer et al.
5,203,135 A 4/1993 Bastian
D335,409 S 5/1993 Kellems
5,208,928 A 5/1993 Kuck et al.
5,223,229 A 6/1993 Brucker
D341,737 S 11/1993 Shepherd
5,269,326 A 12/1993 Verrier
D344,802 S 3/1994 Kuck et al.
D345,266 S 3/1994 Koguma
5,329,657 A 7/1994 Bartley et al.
5,339,750 A 8/1994 Smies
5,345,632 A 9/1994 Langenaeken
5,369,825 A 12/1994 Ressby
5,369,827 A 12/1994 Parke et al.
5,403,549 A 4/1995 McNeil
5,426,795 A 6/1995 Harty
D365,224 S 12/1995 Pohlman
5,472,270 A 12/1995 Czarnecky et al.
5,496,105 A 3/1996 Czarnecky et al.
5,507,050 A 4/1996 Welner
D370,572 S 6/1996 Lin
5,528,782 A 6/1996 Pfeuller et al.
5,538,215 A 7/1996 Hosey
5,564,662 A 10/1996 Lussi et al.
5,565,834 A 10/1996 Hanley
5,568,209 A 10/1996 Priester et al.
5,568,817 A 10/1996 Harty et al.
5,628,078 A 5/1997 Pennington et al.
5,638,644 A 6/1997 Bastian
5,645,313 A 7/1997 Best et al.
5,655,238 A 8/1997 Stickey et al.
5,660,405 A * 8/1997 Campbell ..... 182/88
5,661,859 A 9/1997 Schaefer
5,678,267 A 10/1997 Kinder
5,680,957 A 10/1997 Liu
D386,634 S 11/1997 Daugs
5,706,678 A * 1/1998 Sasaki ..... 312/228
5,754,997 A 5/1998 Lussi et al.
5,771,513 A 6/1998 Kirchgeorg et al.
5,781,943 A 7/1998 Moenning et al.
5,855,207 A 1/1999 Moenning et al.
5,860,899 A 1/1999 Rassman
D404,945 S 2/1999 Simpkins et al.
D408,537 S 4/1999 Stickley et al.
D408,538 S 4/1999 Simpkins et al.
D408,539 S 4/1999 Simpkins
5,913,773 A 6/1999 Cox
5,919,131 A 7/1999 Smoler et al.
5,924,960 A 7/1999 Cohen
5,926,876 A 7/1999 Haigh et al.
5,953,773 A 9/1999 Asada et al.
D417,098 S 11/1999 Teufel et al.
D417,571 S 12/1999 Teufel et al.
D418,225 S 12/1999 Simpkins et al.
6,023,800 A 2/2000 Stickley
6,038,718 A 3/2000 Pennington et al.
6,073,284 A 6/2000 Borders
D428,629 S 7/2000 Cohen
6,101,652 A 8/2000 Matern, Jr.
6,106,065 A 8/2000 Carroll
6,115,978 A 9/2000 Bastian et al.
6,131,214 A 10/2000 Moenning et al.
6,173,461 B1 1/2001 Alexander
6,202,230 B1 3/2001 Borders
6,209,463 B1 4/2001 Koharchik et al.

6,212,713 B1 4/2001 Kuck et al.
6,276,012 B2 8/2001 Borders
6,295,671 B1 10/2001 Reesby et al.
6,351,678 B1 2/2002 Borders

* cited by examiner

Fig. 1
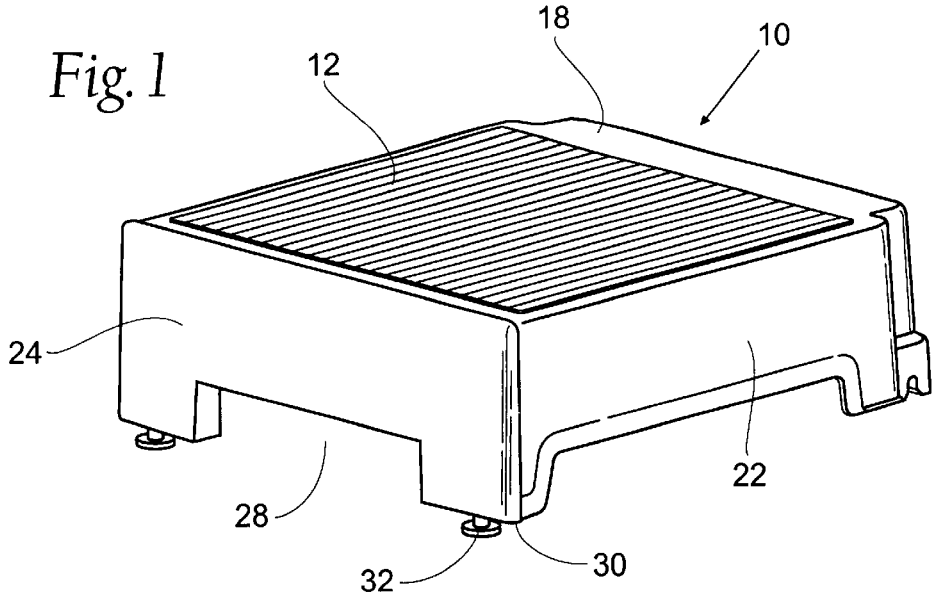
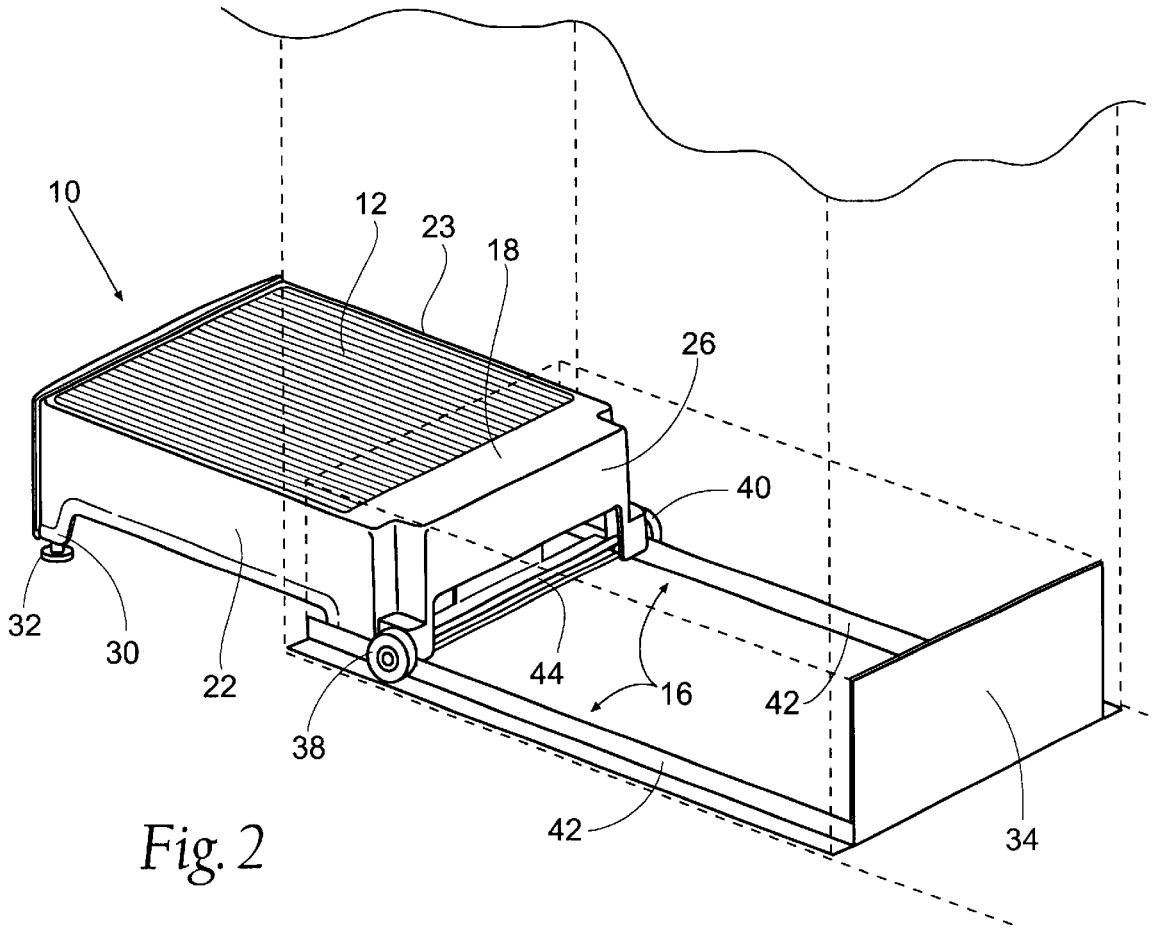
Fig. 2

Fig. 5
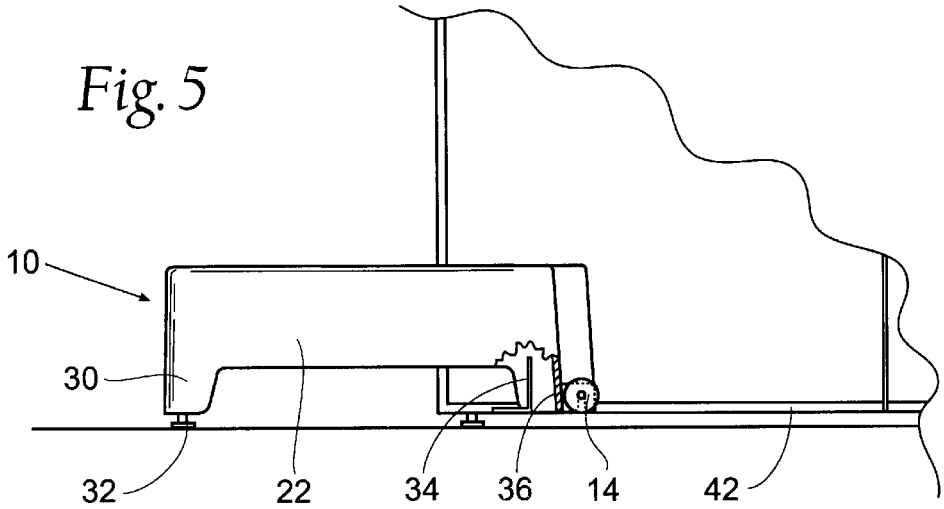
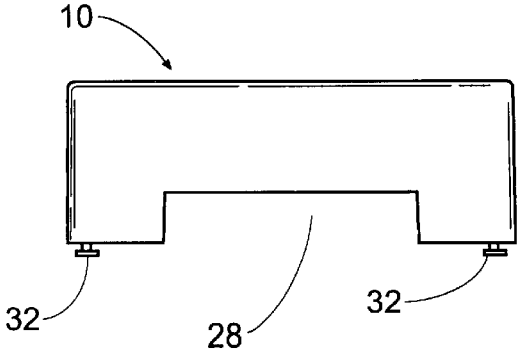
Fig. 6
Fig. 7
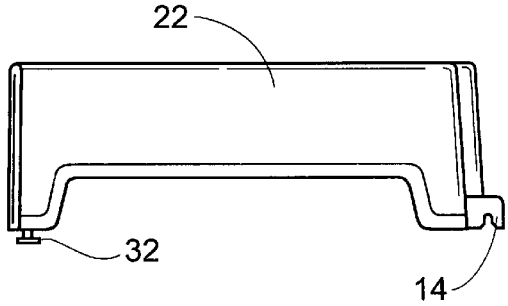
Fig. 8
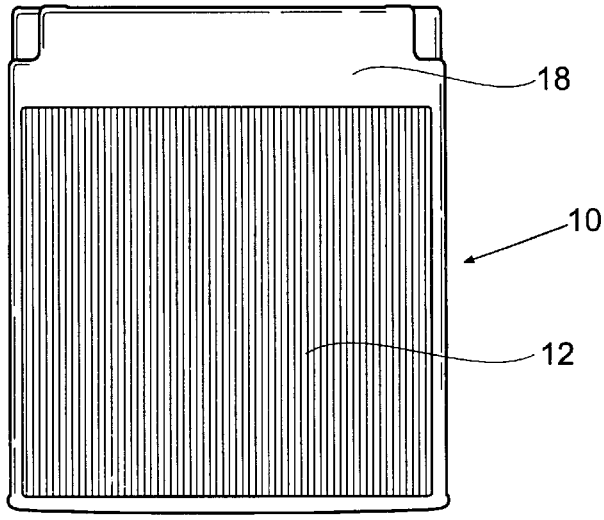

MEDICAL EXAMINATION TABLE STEP

FIELD OF THE INVENTION

The present invention relates to a medical examination table. More particularly, the present invention is directed to a medical examination table having a self-supporting and retractable step.

BACKGROUND OF THE INVENTION

Many conventional medical examination tables have a step that is movable from a stored position to a position for use by the patient as an aid to mount the examination table. Typically, such steps incorporated a hinge mechanism, whereby the step rotates from a stored position to a position for mounting, or a cantilevered track configuration whereby the step extends into a useful position in a drawer-like manner.

Retractable steps are desirable on medical examination tables because they provide an aid to the patient when mounting the examination table. Further, the step can be stored in the table when not in use, thus permitting better access to the patient, and removing obstacles from what are typically cramped examination rooms.

By means of example, Kales (U.S. Pat. No. 487,625) describes a cantilevered sliding step with hinged support braces and a pull-out handle.

Another example, Daggett (U.S. Pat. No. 488,649) describes a retractable cantilevered step.

Lentz (U.S. Pat. No. 542,060) describes a hinged step coupled to a leg rest of the examination table. When the leg rest is in a vertical position, the step can be placed in a horizontal position, enabling the patient to mount the examination table. When the leg rests are placed in a horizontal position, the step can be rotated to lie in line with the leg rest by means of the hinge mechanism.

In another example, Grant (U.S. Pat. No. 3,016,275) describes a cantilevered pull-out step that is guided by tracks. The step is retracted by pulling on a lower edge of a front side of the step.

A step is again described by Douglass (U.S. Pat. No. 3,334,951). Douglass uses a cantilevered step that is slideably mounted on guide tracks by means of a guide rail. An upper face of the step has a tread to ensure adequate traction.

Koharchik (U.S. Pat. No. 6,209,463 B1) describes a cantilevered retractable footstool including a runner with a locking mechanism that selectively limits the extension of the step in relation to the table.

One disadvantage common to the prior art is the use of a cantilevered step. The use of such a design compromises patient safety. An overly large step tends to act as a lever and the typical patient would then topple the examination table when using the step. To avoid this, some of the prior art uses a rather narrow cantilevered step. This creates another disadvantage, as the step then is too small for patients to safely mount the examination table. While preventing the table from toppling, such small steps may cause the patient to fall!

In an attempt to alleviate such misfortune, the aforementioned Kales (U.S. Pat. No. 487,625) device incorporates support legs that hinge from the cantilevered step. However, the mechanism that automatically deploys the hinged braces is cumbersome and unreliable. Consisting narrow members and a strap guided by a groove, the mechanism is relatively delicate, susceptible to jamming or breaking and the braces may be inadvertently dislodged by the patient or care provider during use, resulting in a dangerous situation.

Another disadvantage of the prior art is the use of guide tracks and guide rails to slideably retract and extend the step. This arrangement is susceptible to jamming and sticking, as a relatively large frictional surface on the guide rail and guide track are continually in contact. Such designs are largely not self-aligning, which further exaserbates the problem of jamming and sticking.

Another disadvantage of the prior art is a lack of means for preventing over extension or excessive retraction of the step.

Still, another disadvantage of the prior art is the examination table becomes unstable when a patient uses the retractable step to mount the table.

Yet, another disadvantage of the prior art is the steps have a small elevated supporting surface, making it difficult for patients to maneuver and turn on the step while trying to mount the table.

Accordingly, there is a need for a medical examination table that has a retractable step that is self supporting, thereby eliminating the dangerous toppling condition. Further, there is a need for the step to be relatively large in order to facilitate ease of use and patient maneuverability when used.

Still another need exists for a retractable step that slides easily from the stored position to the extended position and returns as easily, without sticking or jamming.

Yet another need exists for such a step to avoid over extension or excess retraction by some self-assuring means.

SUMMARY OF THE INVENTION

An embodiment of the present invention is a step that is self-supporting and retractable, which can be used, for example, with a medical examination table.

A notable feature of the present invention is the ability of the step to be self-supporting. This is important because it provides vital stability to the step when being used as an aid to mount, for example, an examination table. Further, glides are placed on feet that are robust and not susceptible to accidental dislodging by the patient or care provider during use. The self-supporting nature of the step of the present invention eliminates a dangerous condition whereby the examination table topples when the patient uses the step. In one embodiment, the self-supporting feature is accomplished by using feet. The feet have glides, the glides can be, for example, sliding elements or rolling elements. For example, the glides can be adjustable to accommodate uneven surfaces such as self-adjusting, or perhaps manually adjusted. The glides, then, could accommodate uneven surfaces. In one embodiment, the feet are integrated to the wall. However, other structures can easily be adapted by those skilled in the art without deviating from the spirit of the invention.

Another notable feature of the present invention is the large surface area the step provides.

In a preferred embodiment the step has a large elevated supporting surface that is covered by a safety mat, ensuring adequate traction for a patient when using the step. The large top also facilitates patient maneuverability when mounting the examination table.

The step is easily stored and retrieved by simply pulling or pushing on an integrated handle. In this manner, the step may be retracted when not in use, or extended to be used as an aid in mounting an examination table. Medical personnel can use either their hand or foot to easily retrieve and retract the step.

The step further has wheels that roll on tracks inside a medical examination table. The wheels are self-aligning and offer smooth and easy means of retracting or extending the step.

Features and advantages of the inventions are set forth in the following Description and Drawings, as well as in the appended Claims.

DESCRIPTION OF THE DRAWINGS

FIG. 1 is an isometric view of the step of the present invention as viewed generally from the front;

FIG. 2 is an isometric view of the step of the present invention as viewed generally from the back;

FIG. 5 is a detail fragmentary view of a profile of the present invention in relation to the medical examination table, with the step shown in partially extended position with parts broken away for ease in understanding the relationship of cooperating elements;

FIG. 6 is a front elevation view of the step of the present invention;

FIG. 7 is a side elevation view of the step of the present invention;

FIG. 8 is a top view of the step of the present invention; and

DETAILED DESCRIPTION

Figure 3:
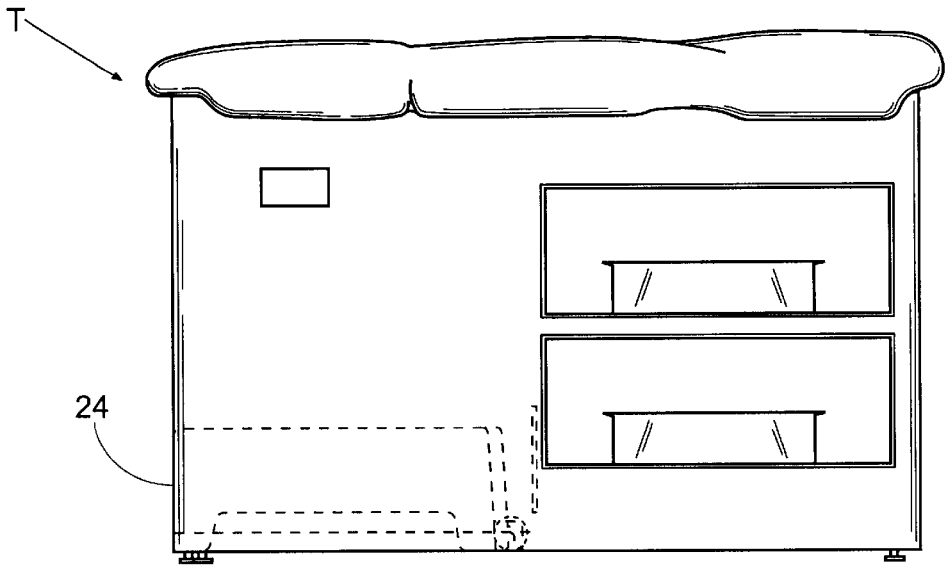
FIG. 3 is a side elevation view of a medical examination table with the step shown in phantom of the present invention in the retracted position.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Medical examination tables having openings for step structures with supporting tracks are generally known in the art. The present invention departs from the convention and introduces a novel step structure that is self supporting. One embodiment of this invention is an extendable and retractable step structure that includes and elevated supporting surface. The elevated supporting surface, in one embodiment, is supported by at least one riser. In a preferred embodiment, the elevated supporting surface is supported by four risers. The four risers form a frame for the elevated surface, and adjacent risers are connected to each other. In the preferred embodiment, there is, for example, a leading front riser with an integrated handle structure. The leading front riser, when the step structure is in the retracted position, sits flush with the surrounding structures of the medical examination table. Also in the preferred embodiment, the step structure has glides that rest on a surface. The surface is the same platform the medical examination table rests upon, for example.

Again discussing one embodiment of the invention, one of the four risers includes a back riser. The back riser carries a rolling element. The rolling element, in turn, rides on a feature of the cabinet opening, adapted to receive the rolling element, such as a track.

Referring to generally to the drawing, and specifically to FIG. 1 and FIG. 2, the present invention is shown in a front and rear isometric view, respectively. It will be observed that the present invention, embodied as a step herein disclosed may be used with conventional 10 for a medical examination table T (not shown) with only minimal changes thereto. The step 10 has a elevated supporting surface 18 with a safety mat 12 resting thereon. The elevated supporting surface 18 is of generous proportion, providing ample space for a patient to stand and maneuver while trying to mount the examination table T (not shown). The safety mat 12 may be of any material that provides suitable traction for patients who might be wearing a variety of footwear, or no footwear. The mat 12 should be of a surface that is easy to clean and disinfect.

In the preferred embodiment, the elevated supporting surface 18 is supported by two risers or side walls 22 23. A leading front wall 24 and a back wall or riser 26 are spaced opposite each other The step structure 10 is preferably and generally rectangular in shape.

In the preferred embodiment, two housings are integrated into the back riser 26. The two housings support a single solid axle 44 in a generally parallel plane to the back riser 26. Rotatably mounted at opposite ends of the axle 44 are a first wheel 38 and a second wheel 40. The wheels 38 & 40 are rotatably mounted to the axle 44 in a manner that allows the wheels 38 & 40 to self-align with an associated track 16.

The track 16 is attached to an interior structure of the medical examining table T The table T provides an opening for the step 10 of the present invention. In the preferred embodiment, the track 16 consists of two generally parallel channels 42 that cooperate with each of the respective rolling elements 38 and 40 to facilitate extraction and retraction of the step 10 from the opening O in the table T. In the preferred embodiment the first wheel 38 and the second wheel 40 and the respective channels 42 are placed at or near the extremity of the overall dimension of the step 10. An alternative embodiment not shown, may comprise a single channel or runner, designed to support one or more wheels at the general center of the overall dimension of the step 10.

Still referring to FIG. 1 and FIG. 2, the leading front riser 24 is spaced from the back riser 26 and adjoining the two side risers 22 23. The leading front riser 24 is integrated to a handle 28. In the preferred embodiment, the handle 28 is formed by a recess in the leading front riser 24, however, many alternative handles 28 are envisioned (not shown), such as at least one handle 28 externally mounted to the leading front riser 24 (not shown), or a plurality of recessed handles 28 (not shown).

Again referring to FIG. 1 and FIG. 2, a foot 30 extends from the side risers 22 23 A glide 32 projects from each foot 30. The glide 32 rests on the floor when the step 10 is extracted and used by patients to mount the examination table T. In one embodiment, the glide is a sliding member and maybe manually adjusted to compensate for irregular variations in the level of the surface or floor. In alternative embodiment not shown, the glide may be a rolling element. In yet another embodiment not shown, the glide may be self leveling. Again, it is anticipated that those skilled in the art would understand that the leveling or height adjusting features of the glide are well known to exist in a myriad of forms, such as, the use of flexible tension members, springs, threaded members and the like.

Figure 4:
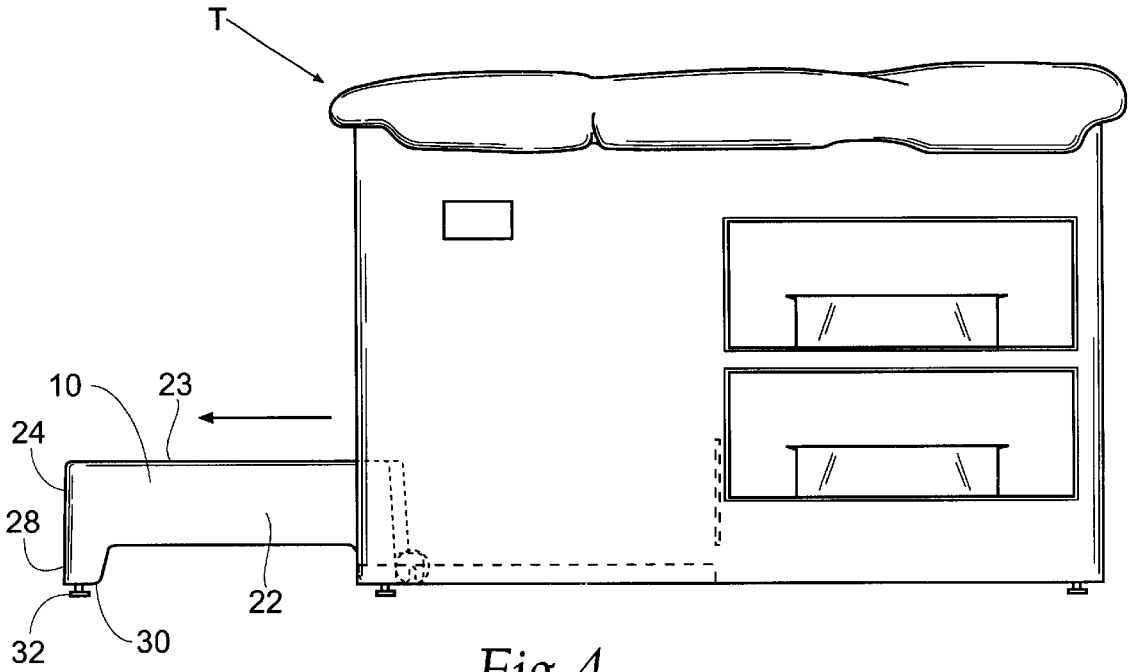
FIG. 4 is a side elevation view of a medical examination table, similar to the view of FIG. 3, with the step of the present invention shown in the extended position.

Now referring to FIG. 3 and FIG. 4, a reference is made to a table T having an opening. The table T is represented by phantom lines. The step 10 of the present invention is shown in relation to the table T. FIG. 3 demonstrates the step 10 in the retracted position. In this position, only the leading front riser 24 is exposed to view. The leading front riser 24 abuts flush with the surrounding structure of the table T. In the retracted position, the step 10 may be selectively extended by pulling on at least one handle 28. FIG. 4 shows the step 10 in the extended position. In this view, the step 10 presents the patient with a large elevated supporting surface 18 that can be used as an aid for mounting the examination table T. Also depicted is the position of the step 10 in the extended position in relation to the table T. As shown, the step 10 extends from the table T, but is not completely removed. A portion of the step 10 remains in the cavity defined by the opening of the table T.

Still referring to FIG. 4, the step 10 in the extended position sits on two glides 32 which project from each foot 30. In the profile view of FIG. 4, one glide 32 is not shown. However, it will be apparent that the step 10 is self-supporting by means of the pair of glides 32 protruding from each foot 30. It will be apparent that the foot 30 acts simply as a means to support the step 10, and alternative means would serve the purpose of providing a self-supporting step 10 equally well. For example, the glide 32 could be directly integrated into one of the risers 22 23 24. Or the foot 30 could rest directly on the floor or the surface of the examination room without the use of a glide 32. In a preferred embodiment, a glide 32 is contemplated to aid the extraction and retraction of the step 10 from the table T. The glide 32 further serves, for example, as a stabilizing element when positioned over uneven surfaces.

Now referring to FIG. 5, a profile view of the step 10 and a cut-a-way view of the related table T are depicted. From this figure, it can be seen that the step 10 is prevented from excessive retraction by means of a stop 34 located on an internal structure of the table T. Also depicted is a brace 36 on a second structure of the table T. The brace prevents hyper-extension of the step 10 in the extended position. In an embodiment, the brace 36 and the stop 34 are depicted as separate elements. In alternative embodiment, the brace and the stop could be combined into a single structure. In one embodiment, the stop 34 is a pre-existing structure on the medical examination table T (not shown).

Still referring to FIG. 5, one of the pair of parallel channels 42 is depicted. The rolling element 14 rolls on the respective channel 42. The second runner is not shown, but its function and structure is understood by a person skilled in the art.

Figure 9:
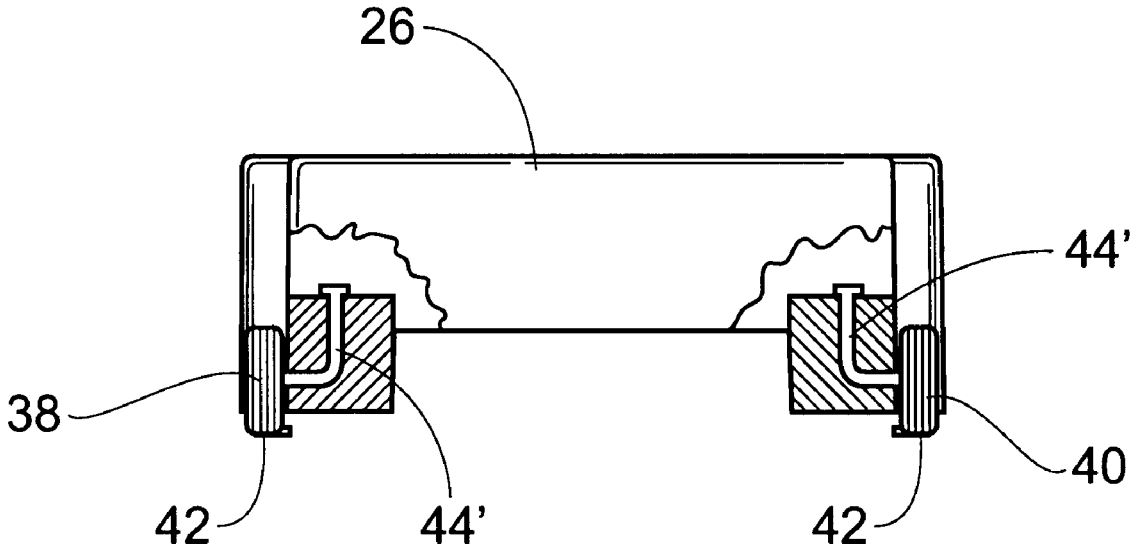
FIG. 9 is a rear view of an alternative embodiment with parts broken away to illustrate the relationship of cooperating elements.

As shown in FIG. 9, an anticipated alternative embodiment of the present invention is the use of the first wheel 38 and the second wheel 40, each carried by a respective housing by two separate bent axles 44'. In this manner, the wheels can orient themselves in each respective track 42 independent of each other. This is advantageous because it creates a robust design and permits smoother extraction of the step from the examination table if, for example, the tracks should be not be parallel. Further, the two bent members are less likely to become damaged or mis-aligned from assembly or handling or operation.

Another embodiment of the present invention is the incorporation of the housing within the back or side riser of the step. Further anticipated embodiments include a handle or a plurality of handles coupled to the leading front riser of the step. Yet another embodiment of the current invention includes the use of rolling elements in lieu of sliding glides.

It will be apparent that the step 10 maybe made from a variety of material. In one embodiment, the step is, for example molded a composite material, such as, a conventional ABS-type plastic. In another embodiment, the step may be fabricated and assembled from metal, such as, 12-gauge sheetsteel.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A step structure for a medical examination table for use by a patient and having an opening for receiving said step structure and a supporting track communicating with said opening, said table being arranged for support by a substantially planar floor surface, said step structure comprising:

a supporting step including a supporting surface, said support step being extendible and retractable in an elevated plane parallel with said planar floor surface;

at least one riser downwardly depending from said surface;

at least one rolling element rotatably supported by said riser and arranged for rolling contact with and directional guidance by said track, said rolling element allowing said step to be moved from a first closed position to a second extended position while remaining in said elevated parallel plane, said step being in supporting engagement of said patient at a selected position along the planar path from said first closed position to said second extended position; and floor glide means underlying said riser and arranged for support of said step structure when said step structure has been moved to said extended position.

2. The step structure of claim 1 wherein the elevated support surface includes a non-slip mat.

3. The step structure of claim 1 wherein the step structure comprises a plurality of risers, each riser depending from the elevated supporting surface and each riser being secured to an adjacent riser.

4. The step structure of claim 3 wherein the plurality of risers includes a leading front riser and a back riser.

5. The step of claim 1 wherein the step structure includes at least one handle structure.

6. The step structure of claim 5 wherein the leading front riser includes the handle structure.

7. The step structure of claim 1 wherein the step structure includes at least one foot member.

8. The step structure of claim 7 wherein the foot member supports the floor glide means.

9. The step structure of claim 1 further comprising a means for retaining the step structure in relative position to the table.

10. The step structure of claim 9 wherein the means for retaining the step comprises a stop member, the stop member being affixed to the table.

11. The step structure of claim 9 wherein the means for retaining the step comprises a brace member, the brace member being supported by the table.

12. The step structure of claim 9 wherein the means for retaining the step comprises a brace member and a stop member, and wherein said brace member and said stop member are spaced apart relative to said first closed position and said second extended position of said step.

13. The brace member of claim 12 wherein the brace member is supported by the table and is adapted to engage the step structure.

14. The stop member of claim 12 wherein the stop member is affixed to the table and is adapted to engage the step structure.

15. The step structure of claim 1 wherein the rolling element comprises a first wheel and a second wheel.

16. The rolling element of claim 15 further comprising at least one axle.

17. A step structure for a medical examination table for use by a patient and having an opening for receiving said step structure and a supporting track communicating with said opening, said table supported on a substantially planar surface, said step structure comprising:

a supporting step including a supporting surface, said supporting step being extendable and retractable in an elevated parallel plane with said planar floor surface, said step being movable from a first closed position to a second extended position while remaining in said elevated parallel plane, said step being in supporting engagement of said patient at a selected position along said elevated parallel plane from said first closed position to said second extended position;

at least one riser downwardly depending from said elevated supporting surface and being height adjustable to said planar surface;

said supporting step including at least one supporting foot on said riser in supporting engagement with said planar surface; and a floor glide means underlying said riser and being supported by said foot and being further arranged for support of said step structure when said step structure has been moved to said selected extended position.

18. The step structure of claim 17 wherein the elevated supporting surface includes a non-slip mat.

* * * * *

UNITED STATES PATENT AND TRADEMARK OFFICE

CERTIFICATE OF CORRECTION

PATENT NO. : 6,550,084 B2
DATED : April 22, 2003
INVENTOR(S) : Siepmann et al.

It is certified that error appears in the above-identified patent and that said Letters Patent is hereby corrected as shown below:

Title page,
Item [73], Assignee, delete "Manomonee Falls" and substitute -- Menomonee Falls --

Signed and Sealed this

First Day of June, 2004

JON W. DUDAS
*Acting Director of the United States Patent and Trademark Office*